US012263387B1

(12) United States Patent
Goryachkin

(10) Patent No.: US 12,263,387 B1
(45) Date of Patent: Apr. 1, 2025

(54) PICKLEBALL PADDLE AND METHODS OF MANUFACTURING THEREOF

(71) Applicant: Ivan Goryachkin, Aventura, FL (US)

(72) Inventor: Ivan Goryachkin, Aventura, FL (US)

( * ) Notice: Subject to any disclaimer, the term of this patent is extended or adjusted under 35 U.S.C. 154(b) by 0 days.

(21) Appl. No.: 18/805,734

(22) Filed: Aug. 15, 2024

Related U.S. Application Data

(60) Provisional application No. 63/541,373, filed on Sep. 29, 2023.

(51) Int. Cl.
*A63B 59/40* (2015.01)
*A63B 102/08* (2015.01)

(52) U.S. Cl.
CPC ..... *A63B 59/40* (2015.10); *A63B 2102/08* (2015.10); *A63B 2209/023* (2013.01)

(58) Field of Classification Search
CPC ..... A63B 59/40; A63B 59/42; A63B 49/48; A63B 2209/023; A63B 2102/08
See application file for complete search history.

(56) References Cited

U.S. PATENT DOCUMENTS 4,379,554 A * 4/1983 Schuyler ..... A63B 59/40 473/530
11,925,843 B1 * 3/2024 Bicanic ..... A63B 59/40
2017/0136325 A1 * 5/2017 Fox ..... A63B 59/42
2022/0088449 A1 * 3/2022 Marshall ..... A63B 59/42
2023/0047371 A1 * 2/2023 Lee ..... A63B 60/00
2023/0249042 A1 * 8/2023 Barnes ..... A63B 59/42 473/519
2024/0017141 A1 * 1/2024 Filippini ..... A63B 59/42
2024/0286015 A1 * 8/2024 Junkins ..... A63B 59/42

FOREIGN PATENT DOCUMENTS

EP 0701844 A2 * 3/1996
FR 2525114 A1 * 10/1983
WO WO-2024112661 A2 * 5/2024 ..... A63B 59/42

* cited by examiner

*Primary Examiner* — Raleigh W Chiu
(74) *Attorney, Agent, or Firm* — Boris Leschinsky

(57) ABSTRACT

Adjustable pickleball paddle includes a paddle body comprising a flat planar core permanently attached to and positioned in between a pair of identical external faces on both flat sides thereof, and a handle configured to hold and manipulate the paddle, the handle extending from the core and oriented to be co-planar therewith. The flat core is configured to removably accept a first insert or additional inserts to fit within a thickness of the flat core, the first and/or additional inserts are configured to increase the stiffness of the flat core when placed therein, as well as the weight of the paddle. Individual adjustments to the twist weight and swing weight allow customization of the paddle for the individual needs of the player.

12 Claims, 16 Drawing Sheets

PICKLEBALL PADDLE AND METHODS OF MANUFACTURING THEREOF

CROSS-REFERENCE DATA

This patent application claims a priority date benefit from a co-pending U.S. Provisional Patent Application No. 63/541,373 filed on 29 Sep. 2023 with the same title and by the same inventor. The content of this provisional patent application is incorporated herein by reference in its entirety.

BACKGROUND

Without limiting the scope of the invention, its background is described in connection with pickleball paddles. More particularly, the invention describes a novel paddle design and manufacturing methods for producing such a paddle.

Pickleball is a popular racquet sport that combines elements of tennis, badminton, and table tennis. It is typically played on a rectangular court with a net in the middle, and it can be enjoyed by people of all ages and skill levels. The game involves two to four players, and the objective is to score points by hitting a small, perforated plastic ball (similar to a wiffle ball) over the net and into the opposing team's court.

Pickleball paddles, also sometimes referred to as racquets, are an essential part of the game. These paddles are typically made of lightweight materials like wood, composite, or graphite, featuring a flat, solid face with no strings. The size and shape of the paddles resemble oversized table tennis paddles. Players use the paddles to volley, serve, and return shots with precision and control. The non-stringed surface allows for different techniques, such as dinking (a soft, controlled shot close to the net) and smashing (a powerful overhead shot) to outmaneuver opponents. Pickleball's popularity has been on the rise due to its accessibility, making it a social and competitive sport enjoyed by many.

A high-quality pickleball paddle should meet several key requirements to enhance a player's performance and enjoyment of the game. Firstly, it should be made from premium materials, often featuring a composite or graphite face for durability and responsiveness. The core of the paddle may be made from materials like polymer or honeycomb, which provide a good balance of power and control. Weight is a crucial factor, with most paddles falling in the range of 6.5 to 8.5 ounces; players can choose a weight that suits their playing style. A comfortable grip is vital, typically wrapped with cushioned, moisture-absorbing materials to reduce hand fatigue and provide a secure hold. The size of the paddle's face, regulated by the USAPA (USA Pickleball Association), should be within specific dimensions, ensuring fairness in play. Lastly, the design and aesthetics of the paddle may vary, offering a personal touch for players. Ultimately, a high-quality pickleball paddle should combine these elements to offer a balance of power, control, comfort, and durability, tailored to the player's preferences and skill level.

The materials used to make the face and core of a pickleball paddle play a significant role in determining the paddle's performance characteristics. High-quality paddles often feature advanced materials to optimize power, control, and durability. Face materials may include the following:

- Carbon Fiber: Carbon fiber is a popular choice for the face of premium pickleball paddles. It offers an exceptional strength-to-weight ratio, providing both power and responsiveness. Carbon fiber faces are known for their stiffness, which translates into increased ball speed, making them ideal for aggressive players who rely on powerful shots;
- Fiberglass: Fiberglass is another commonly used material for paddle faces. It offers a balance between power and control. The inherent flexibility of fiberglass can provide a bit more "feel" in touch shots while still generating enough power for aggressive play;
- Composite Blends: Many high-end paddles use composite materials that combine both carbon fiber and fiberglass. These blends aim to strike a balance between power and control, catering to a wider range of playing styles. They offer the benefits of both materials, making them versatile choices for intermediate to advanced players.

Core Material selection is another important consideration when creating a high-quality paddle. Conventional choices may include the following:

- Polymer: Polymer cores are prevalent in pickleball paddles and are known for their soft, cushioned feel upon contact with the ball. This core material provides excellent control and minimizes vibrations, making it a favorite among players who prioritize touch and finesse shots. Polymer cores come in various densities, allowing players to choose the level of firmness that suits their preferences;
- Honeycomb Composite: Honeycomb cores are typically made from a lightweight, sturdy material such as Nomex, aluminum, or aramid. These cores offer a good balance between power and control. The honeycomb structure provides excellent durability and responsiveness, making it a popular choice among competitive players;
- EVA Foam: Some paddles use EVA (Ethylene-Vinyl Acetate) foam cores, which offer a soft, forgiving touch and absorb shock effectively.
- EVA foam cores provide a comfortable feel and are favored by players who prioritize comfort and control over power;
- PVC Cores: PVC (Polyvinyl Chloride) cores are less common but offer a cost-effective alternative. They tend to be on the heavier side, providing additional power. However, they may lack the touch and control of other core materials.

It's important to note that the combination of face and core materials, along with other factors like weight distribution and grip size, significantly influences a paddle's overall performance characteristics. Players can choose paddles with specific face and core materials to match their playing style, whether it's geared toward power, control, spin, or a balanced combination of these attributes. Experimenting with different materials can help players find the perfect paddle to suit their individual preferences and needs on the pickleball court.

The surface structure and texture of a pickleball paddle are further critical factors, especially for players who want to add spin to their shots. A high-quality paddle often features a specific texture on its face to enhance the player's ability to put spin on the ball. The texture is created over the external layer of the paddle through various methods, such as a rough surface or small indentations, which can significantly affect how the ball interacts with the paddle. The following is a specific description of various desired features of a high-end pickleball paddle as it relates to the surface characteristics thereof:

- Grip and Control: The texture on the paddle's surface should facilitate a better grip and control over the ball. When players apply spin, the texture creates friction between the ball and the paddle, allowing them to generate more topspin, backspin, or sidespin. This added control is essential for placing the ball precisely where they want it on the court, making it harder for opponents to anticipate and return;

Spin Variability: Different types of surfaces can produce various types of spin. A rougher surface, for instance, is excellent for generating topspin, which causes the ball to dip quickly after crossing the net. Conversely, a smoother surface may be better for backspin or slice shots, making it challenging for opponents to handle the ball consistently. A proper balance is required to satisfy both requirements as much as possible;

Serve and Return: Surface texture is particularly crucial for serving and returning in pickleball. When serving, players can add spin to create unpredictable ball movement, making it difficult for the receiver to read the serve. On the return, a textured paddle can help players neutralize and control the spin on the incoming ball;

Advanced Techniques: For advanced players, the structure and texture on the paddle's surface allow for more sophisticated shot-making. This includes the ability to disguise spin, perform drop shots, or engage in dinking rallies at the net, all of which are essential aspects of high-level pickleball play;

Personal Preferences: Different players may have varying preferences for paddle surfaces. Some may favor a rougher surface for more aggressive spin, while others may opt for a smoother texture for better touch and control.

Overall, the surface structure and texture of a pickleball paddle play a pivotal role in a player's ability to impart spin on the ball. It enhances grip, control, and shot versatility, enabling players to add spin strategically to their shots. This added dimension to gameplay can make the difference between a good and great pickleball player, particularly when it comes to outmaneuvering opponents and winning points.

When it comes to a method of manufacturing a pickleball paddle, a typical manufacturing process involves several steps. Each of these steps is crucial for achieving the desired quality and performance. Firstly, the core material, typically made of materials like polymer or foam, is molded into the desired shape and dimensions, accounting for weight distribution and paddle balance. Next, the face material, commonly graphite, fiberglass, or composite, is laid over the core and bonded using advanced adhesives or resin. This step ensures durability and responsiveness during gameplay. Once the core and face are bonded, the edges of the paddle are carefully trimmed and smoothed to achieve uniformity and prevent sharp edges that could affect play or pose safety risks. Following this, the paddle undergoes a curing process, where it's subjected to controlled heat and pressure to solidify the materials and enhance their properties. After curing, the paddle is inspected for any imperfections or defects and undergoes surface treatments such as sanding or polishing to achieve a smooth finish. Finally, branding, labeling, and grip application complete the manufacturing process, resulting in a high-quality pickleball paddle ready for market distribution. This traditional process has a lot of room for improvement when it comes to manufacturing premium-quality paddles. Improvements are needed to consistently produce a high quality pickleball paddle.

None of the prior art pickleball paddles are known to satisfy all of the above requirements adequately. The need exists, therefore, for a novel pickleball paddle and methods of manufacturing thereof are needed to provide a better experience for an advanced player.

A further consideration for selecting the optimum pickleball paddle is its weight. The weight of a pickleball paddle significantly influences the playing experience, especially for users of varying heights and weights. Generally, pickleball paddles range from light (less than 7.3 ounces) to medium (7.3 to 8.4 ounces) to heavy (more than 8.4 ounces). Each category affects a player's performance differently, and the impact can vary based on the player's physical attributes.

For lighter players, particularly those with a smaller stature, a lighter paddle is often preferable. It allows for quicker reactions and easier maneuverability, which is crucial for maintaining speed and agility during fast-paced exchanges. A lighter paddle reduces the strain on the wrist and arm, minimizing the risk of fatigue and injury, which is particularly beneficial for those who might lack the muscle strength to handle heavier equipment comfortably. This makes it easier for lighter players to maintain control and precision without compromising their physical endurance.

Conversely, heavier paddles offer more power and stability, which can be advantageous for taller and heavier players. These individuals typically have more muscle mass and strength, enabling them to handle the additional weight without as much risk of fatigue. The added heft of a heavier paddle can enhance shot power, making it easier to drive the ball with force. Additionally, the stability provided by a heavier paddle can improve control during powerful volleys and smashes, benefiting players who rely on strength and reach.

However, it's essential to find a balance. For a heavier player, an overly heavy paddle might still lead to quicker fatigue and potential strain, impacting their endurance over extended matches. Similarly, a very light paddle might not provide enough power for taller players to effectively utilize their reach and strength. Therefore, players must consider their own physical attributes and playing style when selecting a paddle.

A further examination of the details of the pickleball paddle design distinguishes between the swing weight and the twist weight of the paddle. The concepts of twist weight and swing weight in pickleball paddles, while related to how the paddle feels and performs during play, refer to different aspects of the paddle's dynamics and have distinct implications for players.

Twist weight, also known as torsional stability, refers to the paddle's resistance to twisting around its longitudinal axis. This measure is crucial during off-center hits, where the paddle tends to twist if struck away from the sweet spot. A higher twist weight means the paddle is more resistant to such twisting motions, resulting in better control and stability. Players who frequently deal with off-center hits or those who prefer a solid feel during contact will benefit from a paddle with a higher twist weight. This attribute is especially beneficial for beginners or intermediate players who might not consistently hit the ball in the center of the paddle. The increased stability can lead to fewer mishits and more consistent play.

On the other hand, swing weight, or moment of inertia, describes how heavy the paddle feels when swung. It accounts for the distribution of weight throughout the paddle, including the head and handle. A paddle with a high swing weight will feel heavier and require more effort to swing but will provide more power and momentum, beneficial for hard-hitting players who rely on powerful shots. Conversely, a paddle with a low swing weight feels lighter and is easier to maneuver, allowing for quicker reaction times and faster hand movements, which are crucial for players who emphasize speed and agility in their gameplay.

For players who favor a controlled, precision-based approach, a lower swing weight might be preferable as it enables faster adjustments and less fatigue over extended periods. However, those who prioritize power and force in their shots might opt for a paddle with a higher swing weight, as it can generate more impactful hits without requiring as much additional effort from the player.

In essence, twist weight and swing weight address different aspects of a pickleball paddle's performance. Twist weight focuses on stability and control during off-center hits, enhancing the paddle's consistency and reliability. Swing weight, however, deals with how the paddle feels during a swing, affecting power and maneuverability. Understanding these differences helps players choose a paddle that complements their playing style, whether they prioritize control and stability or power and agility.

All prior art paddles have a fixed weight and mass distribution around the paddle, which does not allow the user to customize the paddle according to their individual height and physical abilities. The need exists for a premium pickleball paddle allowing to adjust the weight thereof as it has a considerable effect on a player's ability to perform, and this effect is nuanced by the player's height and weight. A further need exists for a pickleball paddle allowing to individually adjust its twist weight and its swing weight. A pickleball paddle with adjustable weight may allow customizing the paddle weight that would factor in the player's physical characteristics and playing style to optimize performance and enjoyment of the game.

SUMMARY

Accordingly, it is an object of the present invention to overcome these and other drawbacks of the prior art by providing a novel pickleball paddle with an improved external face.

It is another object of the present invention to provide a novel pickleball paddle with an improved manufacturing method to allow for the production of a paddle with a novel external face.

It is a further object of the present invention to provide a novel pickleball paddle that may be adjustable to support the individual needs and preferences of various players.

It is yet a further object of the present invention to provide a novel pickleball paddle with the ability to individually adjust the swing weight and the twist weight of the paddle.

According to the first aspect of the invention, disclosed is a paddle for playing a ball game of the first embodiment. The ball game may be a pickleball game. The paddle of the first embodiment may include a flat core permanently attached to and positioned in between a pair of identical external faces on both flat sides thereof. Each external face, in turn, may include a rigidized fabric containing aramid fibers. The paddle may further feature a handle configured to hold and manipulate the paddle, with the handle extending from the core and oriented to be co-planar therewith.

According to the second aspect, the paddle for playing a ball game may have a flat core comprising a honeycomb structure.

According to the third aspect, the external face of the paddle may comprise the rigidized fabric containing aramid fibers impregnated with a polymer resin and imprinted with a predefined texture pattern on an external playing side thereof.

According to the fourth aspect, the external face may comprise the rigidized fabric containing aramid fibers interwoven with carbon fibers and impregnated with the polymer resin to have the predefined texture pattern on the external playing side thereof.

According to the fifth aspect, the paddle for playing a ball game may further comprise an edge surrounding the paddle body and attached to the core along the periphery thereof.

According to the sixth aspect, the paddle for playing a ball game may have the rigidized fabric of the external face impregnated with a polypropylene resin at a temperature between 130° C. to 150° C.

According to the seventh aspect, the predefined texture pattern may have a checkered texture pattern.

According to the eighth aspect, the pair of external faces may be fused to the polypropylene honeycomb core at a temperature between 130° C. to 150° C.

According to the ninth aspect, the handle of the paddle may comprise a honeycomb structure integral with the honeycomb core of the paddle body.

According to the tenth aspect of the invention, provided is an adjustable paddle for playing a ball game of the second embodiment, the paddle comprising a paddle body comprising, in turn, a flat planar core permanently attached to and positioned in between a pair of identical external faces on both flat sides thereof, and a handle configured to hold and manipulate the paddle, the handle extending from the core and oriented to be co-planar therewith, wherein the flat core is configured to removably accept a first insert to fit within a thickness of the flat core, the first insert is configured to increase a stiffness of the flat core when placed therein.

According to the eleventh aspect, the adjustable paddle may have the first insert formed to be straight and configured to be inserted into a corresponding first channel made in the flat core and sized to accept the first insert therein.

According to the twelfth aspect, the first channel may be positioned along a longitudinal axis of symmetry of the paddle.

According to the thirteenth aspect, the first channel may have a first channel opening on a side of the paddle opposite the handle, thereby the paddle is configured to accept the first insert when placed into the first channel via a first channel opening.

According to the fourteenth aspect, either the first channel or the first insert may be equipped with a first fastener configured to retain the first insert when placed within the first channel.

According to the fifteenth aspect, the first insert may have a length exceeding at least one-half of the length of the flat core as measured from the handle, thereby when inserted, the first insert traverses more than one-half of the flat core of the paddle.

According to the sixteenth aspect, the first insert may itself comprise a first portion serially attached to a second portion.

According to the seventeenth aspect, the first insert may be tubular with a rigid outer wall.

According to the eighteenth aspect, the first insert may comprise at least a first tubular portion inserted concentrically into a second tubular portion.

According to the nineteenth aspect, the adjustable paddle may further comprise a pair of a second insert and a third insert configured for removable placement in a second channel and a third channel of the flat core, one on both sides of the first insert.

According to the twentieth aspect, the second channel and the third channel may be evenly spaced apart from the first channel in the flat core and may be positioned on both sides thereof.

According to the twenty-first aspect, the paddle may be configured to be used in one of the following configurations:

i. with no inserts present, thereby providing a configuration with the lowest paddle weight, ii. with only the first insert present, thereby increasing the paddle weight and increasing swing weight, while not changing the twist weight of the paddle, iii. with only the second insert and the third insert present, thereby further increasing paddle weight and also increasing twist weight, and iv. all three inserts present, thereby providing for maximum paddle weight, maximum swing weight, and maximum twist weight, thereby providing the paddle with adjustable playing parameters to suit individual players.

According to the twenty-second aspect, all inserts may be identical and interchangeable with each other.

According to the twenty-third aspect, the first insert, the second insert, and the third insert may form together a first set of inserts. The paddle may further comprise a second set of inserts configured to be inserted into the corresponding channels in the flat core of the paddle in place of the first set of inserts, the second set of inserts having a respective weight that is different from the first set of inserts.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through the use of the accompanying drawings, in which:

DETAILED DESCRIPTION OF PREFERRED EMBODIMENTS OF THE INVENTION

Figure 1:
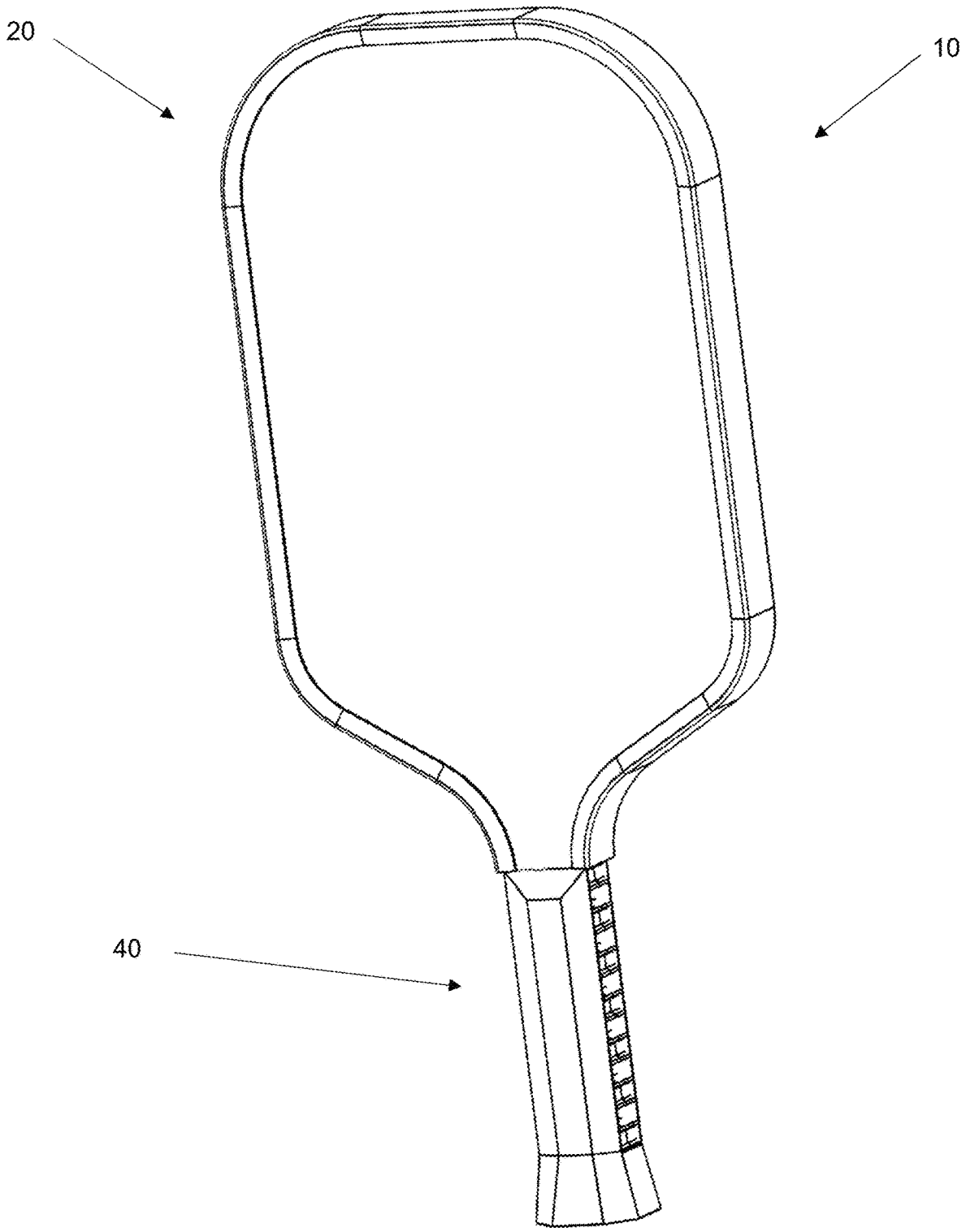
FIG. 1 is a first perspective view of the first embodiment of the invention.

The following description sets forth various examples along with specific details to provide a thorough understanding of the claimed subject matter. It will be understood by those skilled in the art, however, that claimed subject matter may be practiced without one or more of the specific details disclosed herein. Further, in some circumstances, well-known methods, procedures, systems, components, and/or circuits have not been described in detail in order to avoid unnecessarily obscuring the claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Ball Paddle with Improved External Faces

Figure 2:
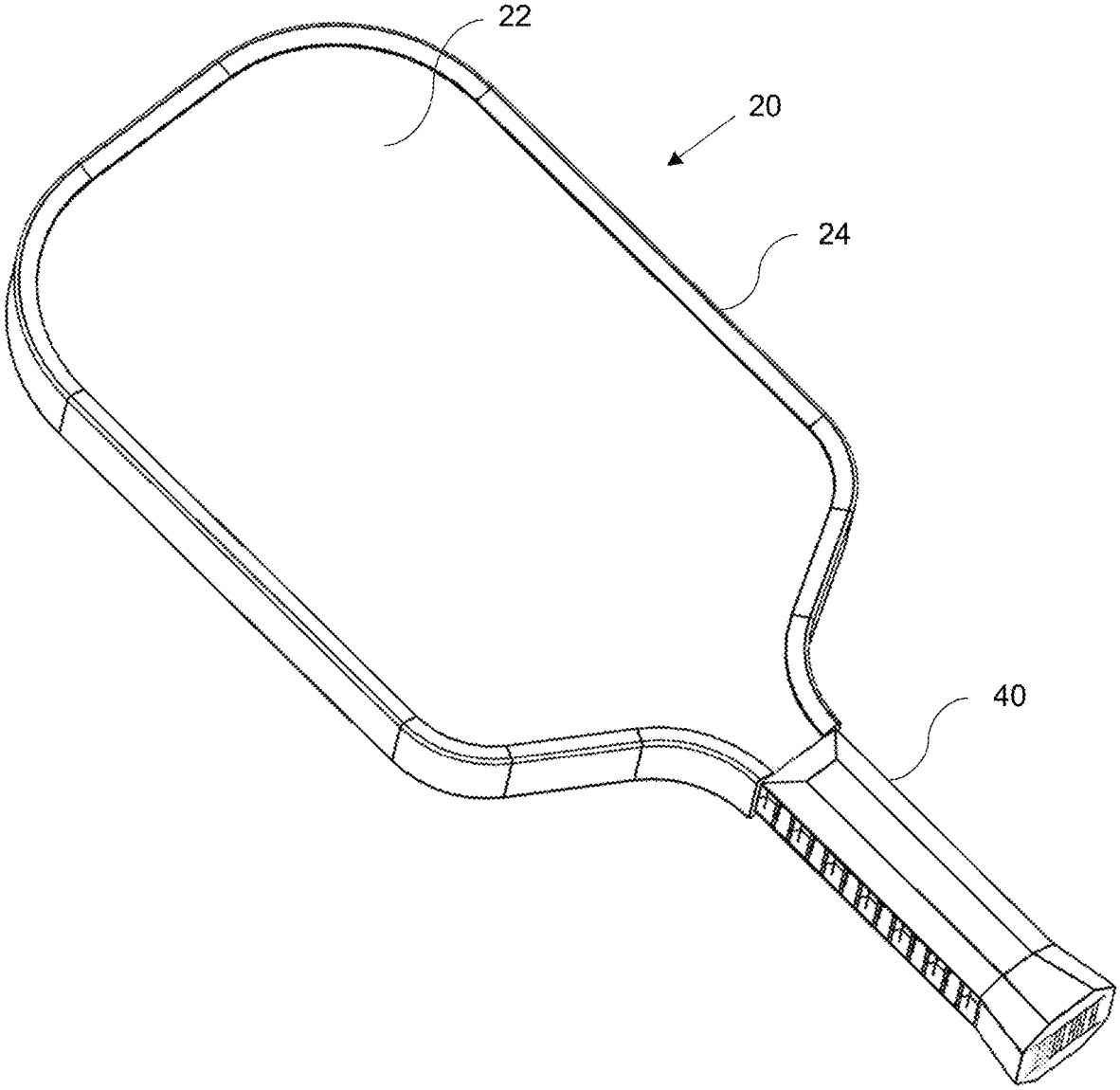
FIG. 2 is a second perspective view of the first embodiment of the invention.
Figure 3:
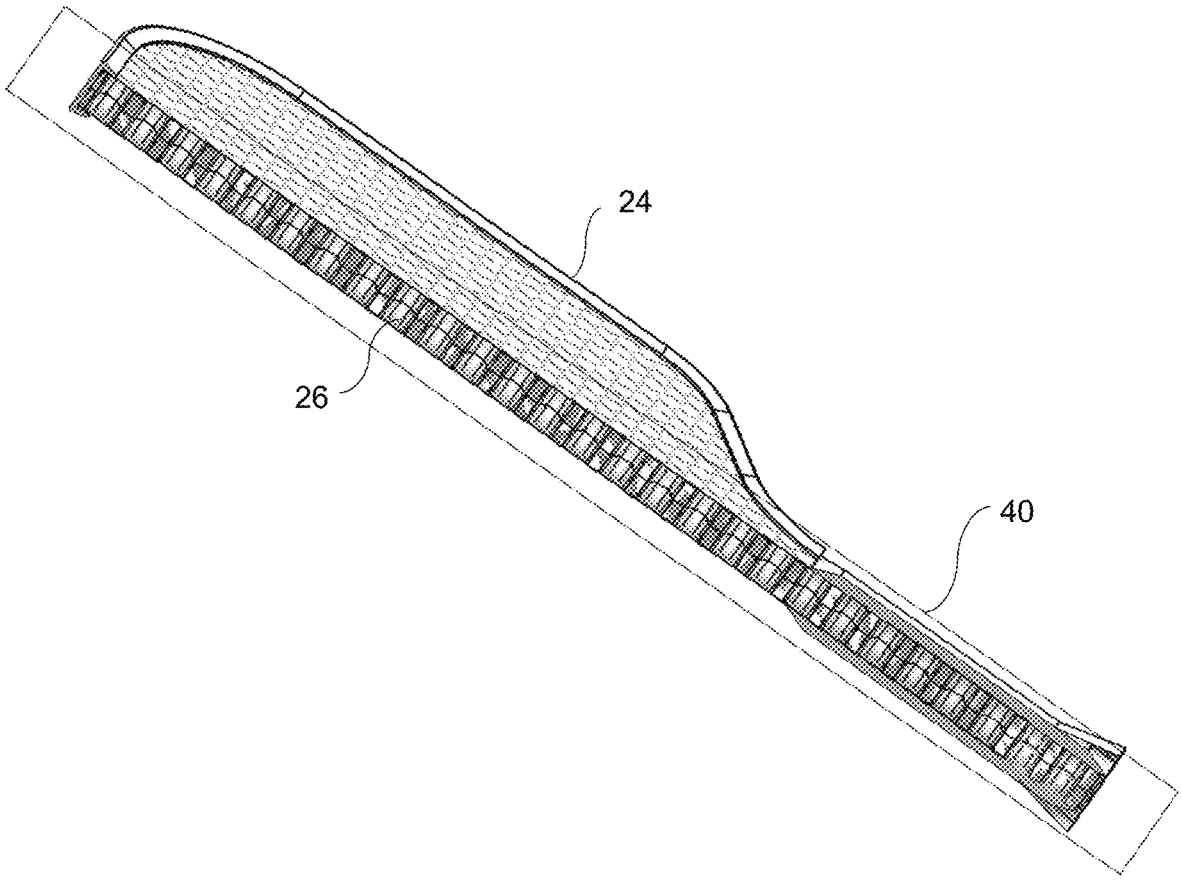
FIG. 3 is a longitudinal cross-sectional view of the same.
Figure 4:
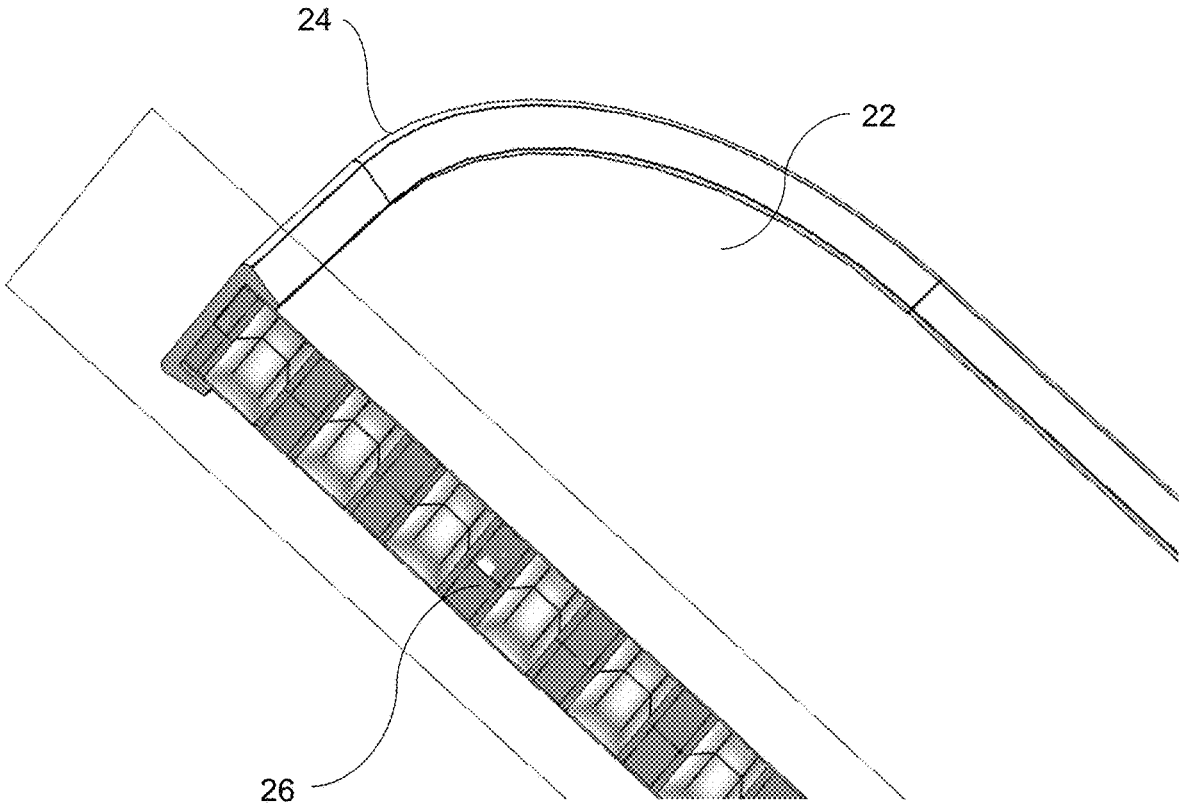
FIG. 4 is a close-up of the cross-sectional view of FIG. 3.
Figure 5:
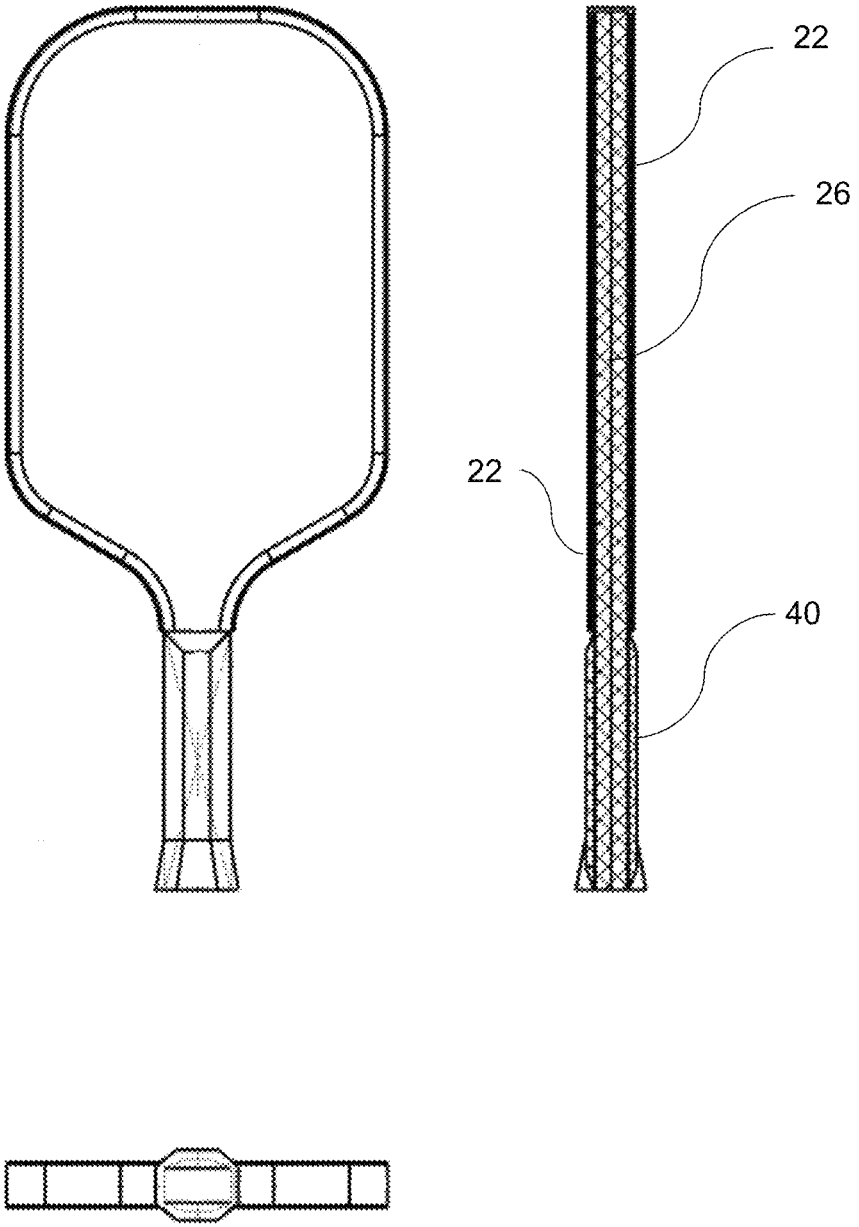
FIG. 5 is a plan view, a side view, and a bottom view of the same.
Figure 6:
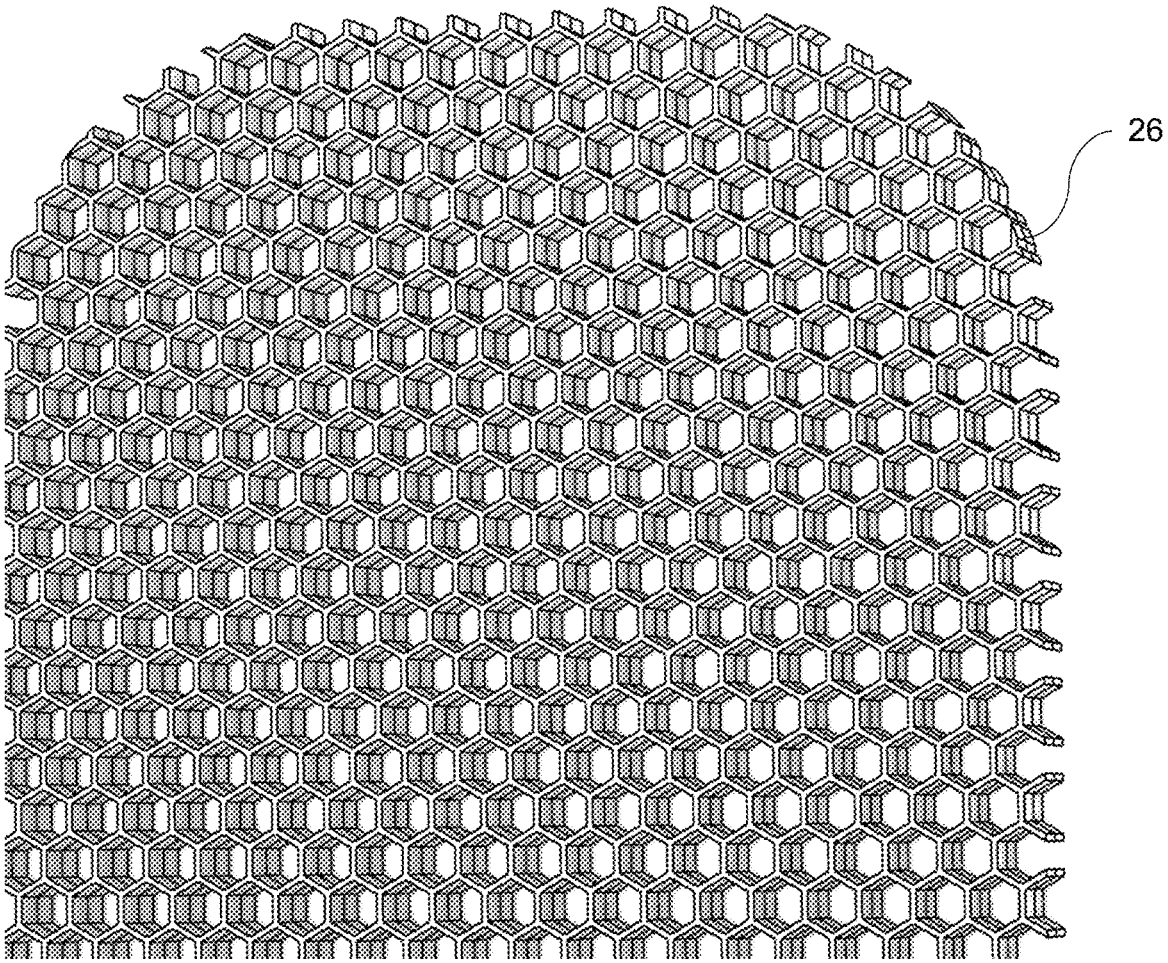
FIG. 6 is a perspective view of the core of the pickleball paddle of the first embodiment.

FIGS. 1 and 2 show two perspective views of the paddle 10 of the first embodiment of the present invention, which generally includes a paddle body 20 and a handle 40 (the handle 40 is shown without a grip cover which may be positioned over and cover thereof). The paddle body 20, in turn, may comprise an external face 22 on both sides of the paddle 10, surrounded by an edge 24. A honeycomb core 26 may be located between the top and the bottom external face 22 and extend into the handle to form structural support of the paddle 10, as seen in cross-sectional views in FIG. 3 and a close-up cross-sectional view in FIG. 4. The exemplary plan, side, and bottom views of the paddle 10 are shown in FIG. 5. In embodiments, the paddle 10 may be about 17" long by about 7" wide with a 6¼" long handle. Other suitable dimensions may also be used to fabricate the ball paddle of the invention, as the invention is not limited in this regard. Details of one exemplary design of the honeycomb core 26 are seen in FIG. 6.

Figure 7:
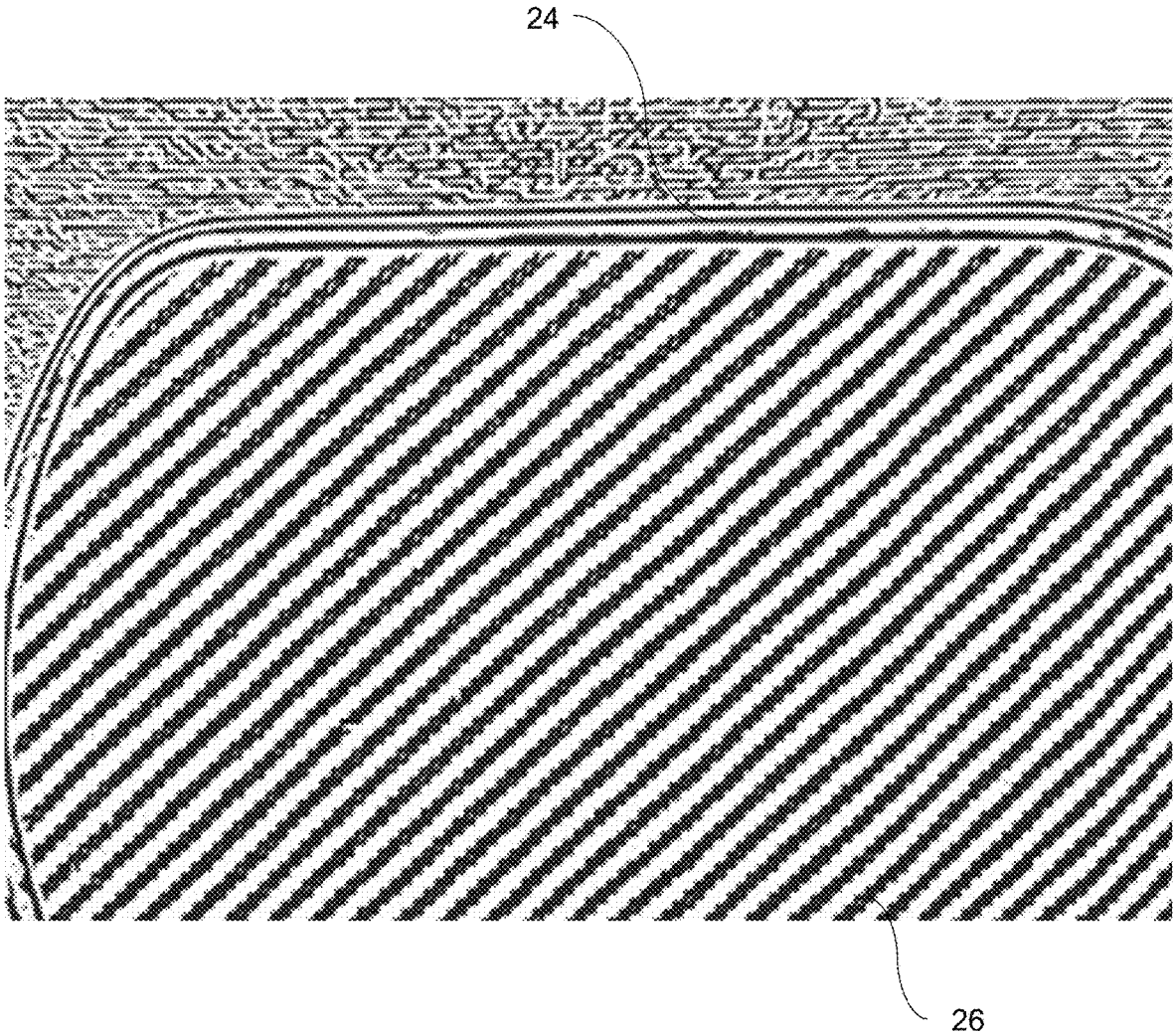
FIG. 7 is a plan view of the external face thereof.
Figure 8:
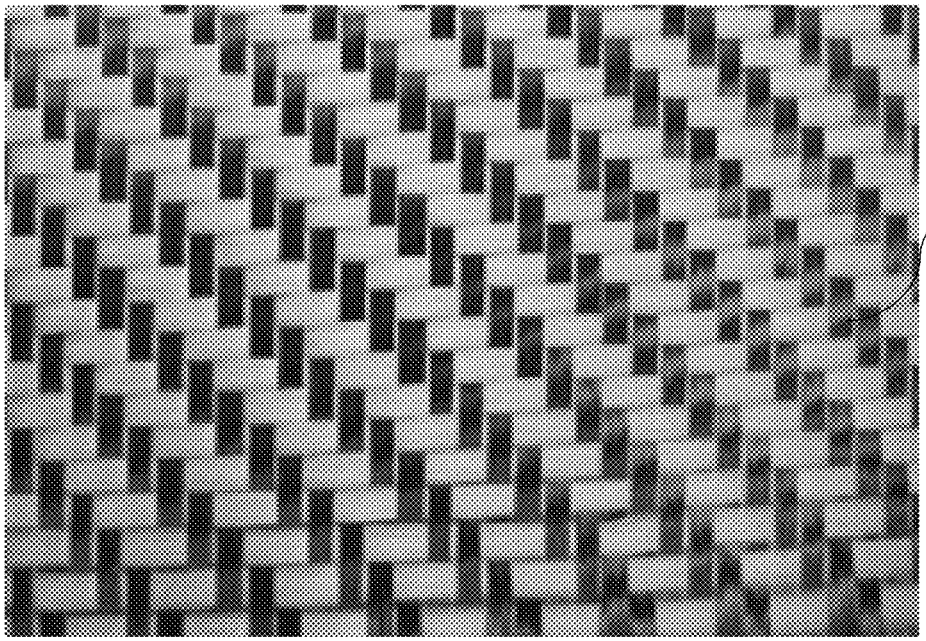
FIG. 8 is a close-up of the external face seen in FIG. 7.
Figure 9:
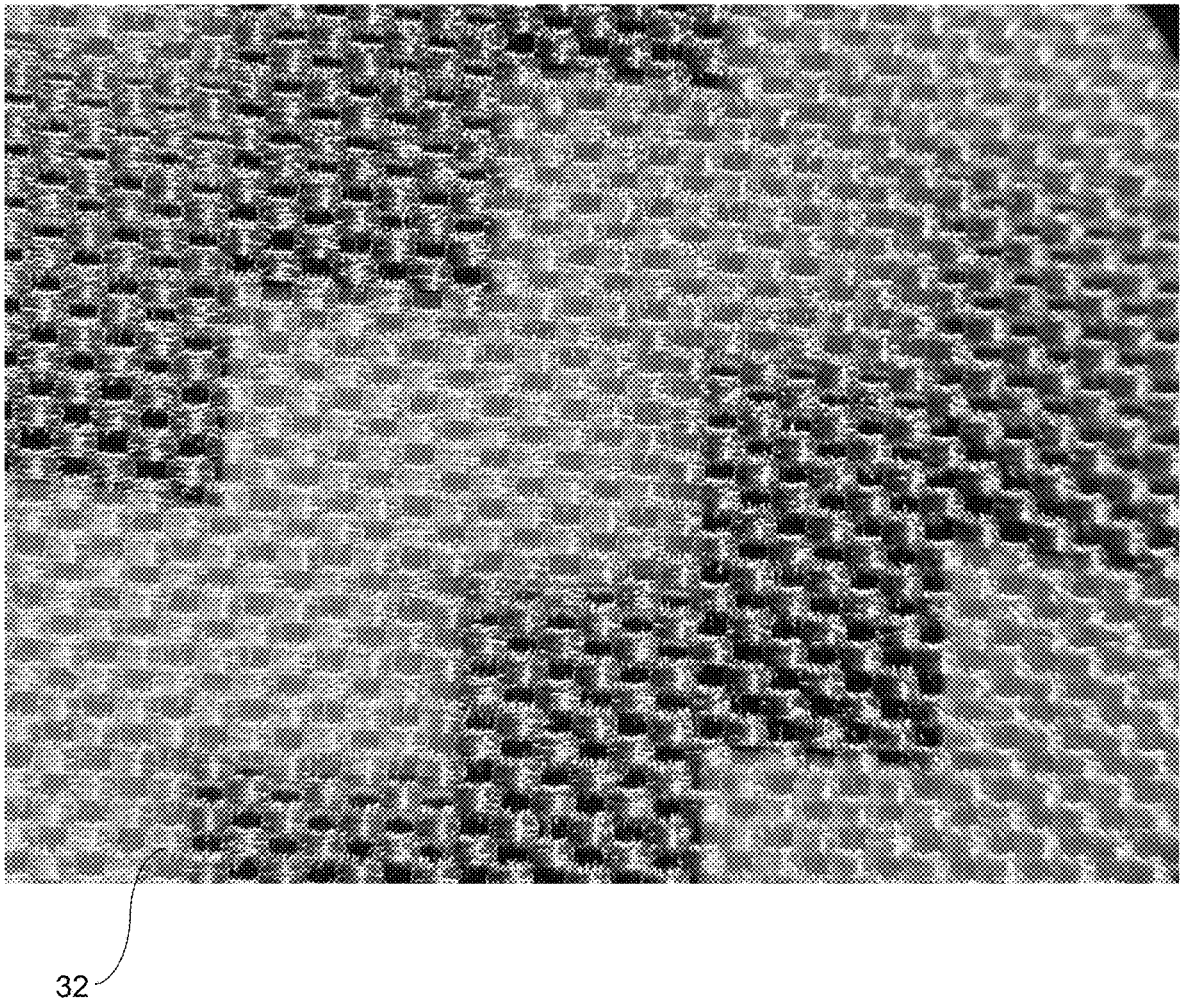
FIG. 9 is a further close-up of the external face seen in FIG. 8.
Figure 10:
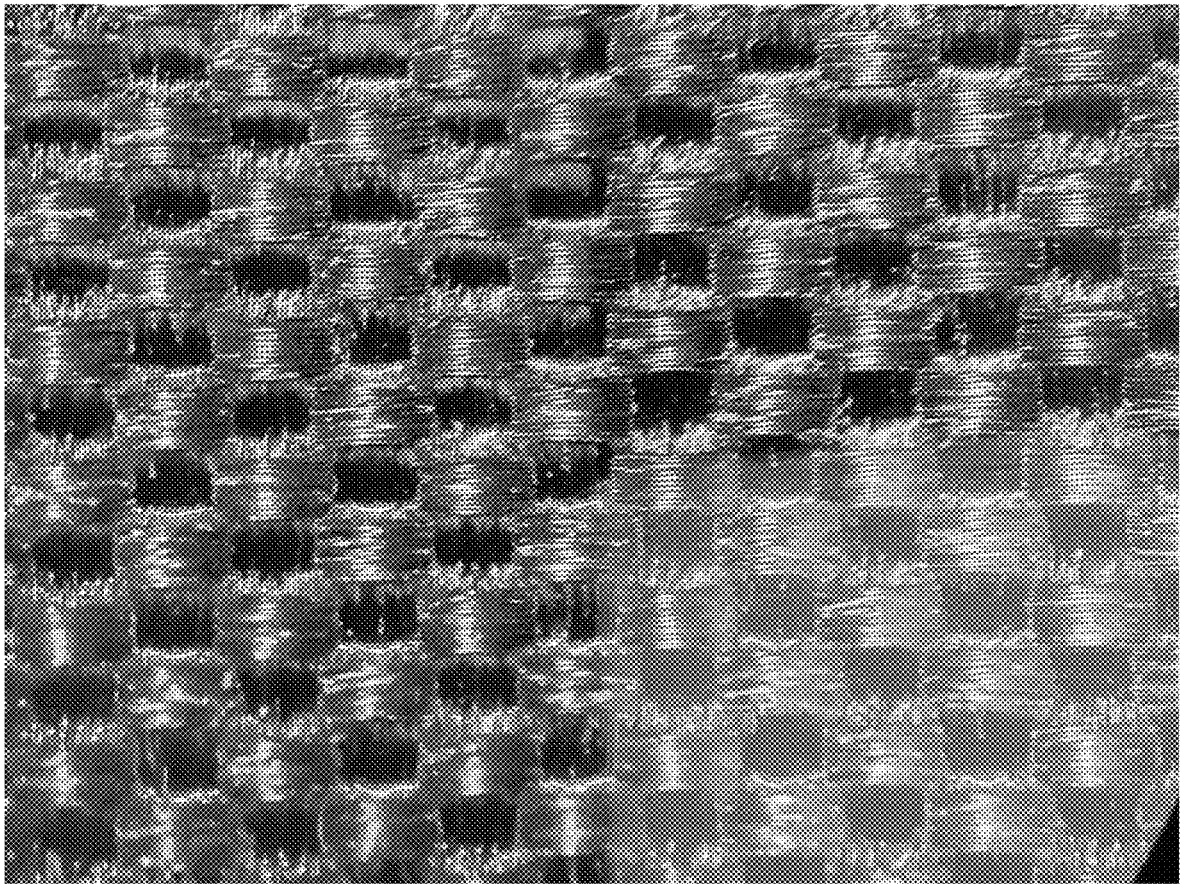
FIG. 10 is a further close-up of the external face seen in FIG. 8.
Figure 11:
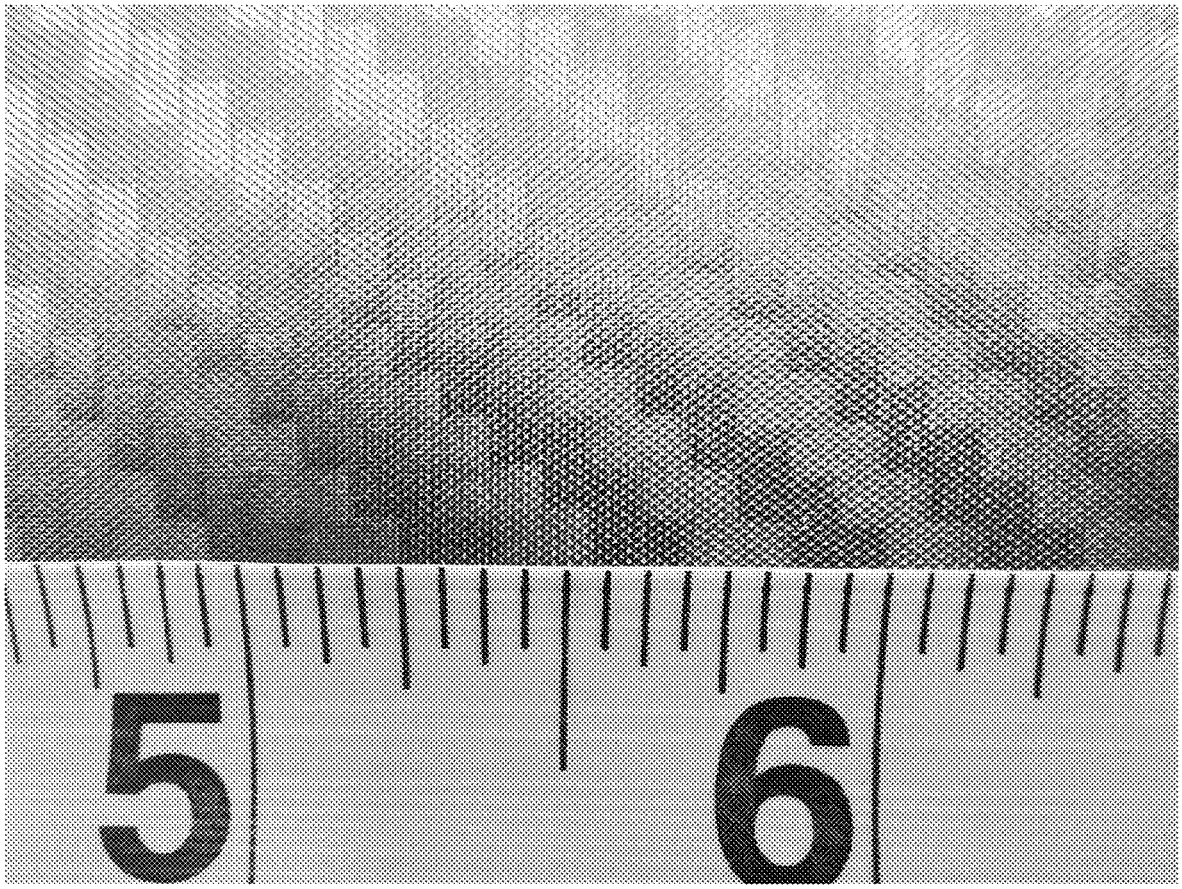
FIG. 11 is yet another close-up of the external face positioned next to an inch-graduated ruler.
Figure 12:
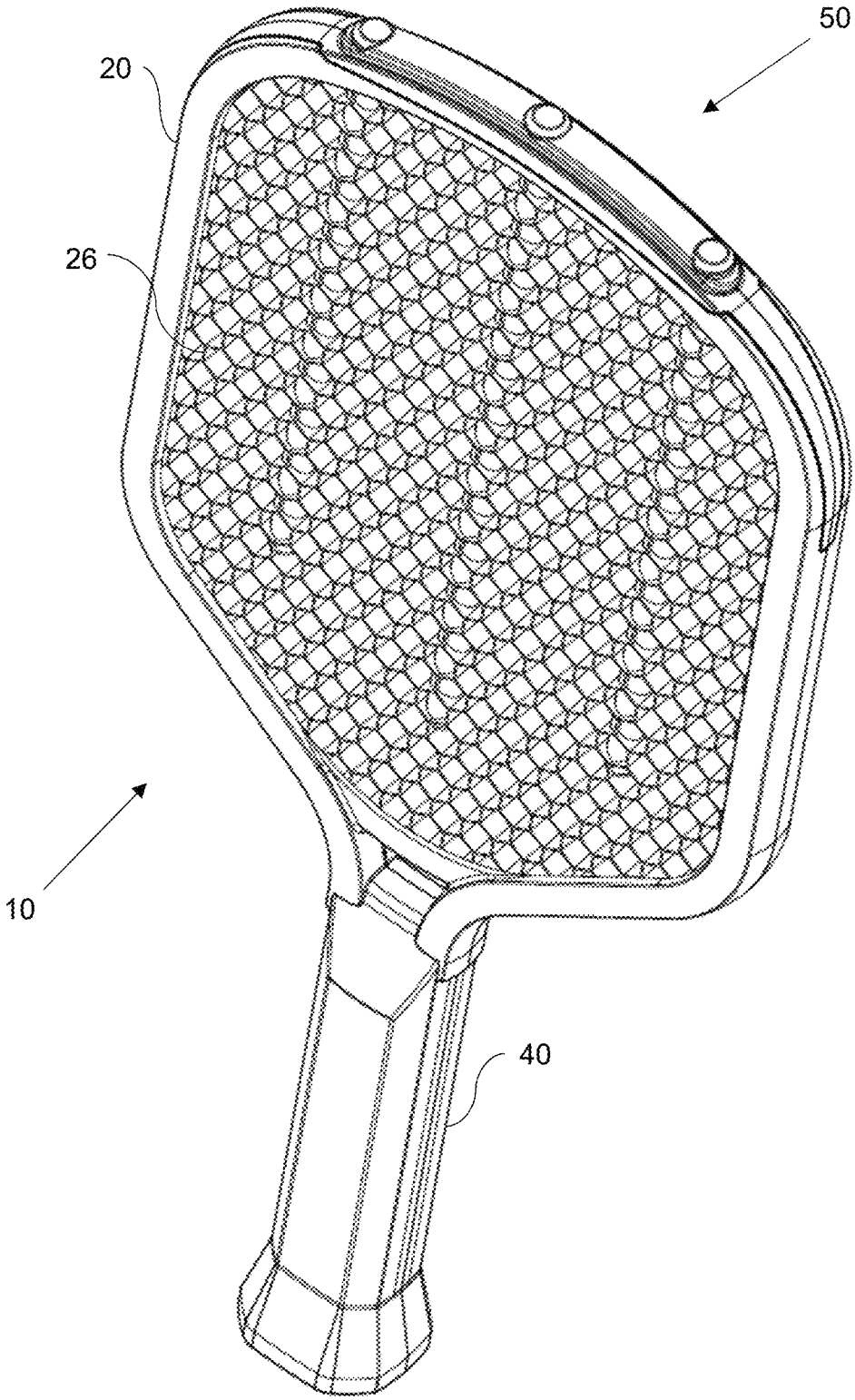
FIG. 12 is a perspective view of the paddle with adjustable weight according to the second embodiment of the invention.
Figure 13:
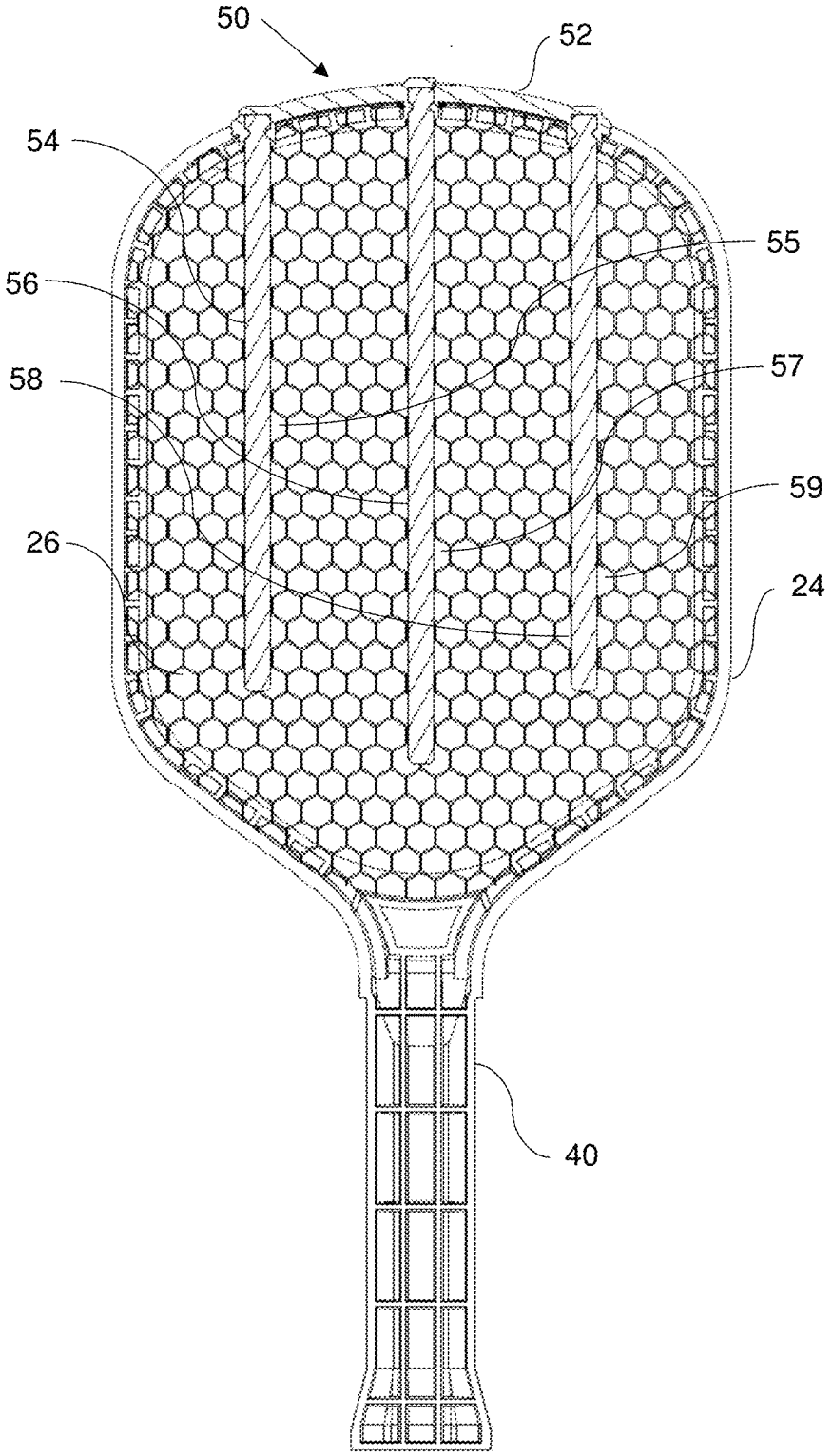
FIG. 13 is a cross-sectional plan view of the same.
Figure 14:
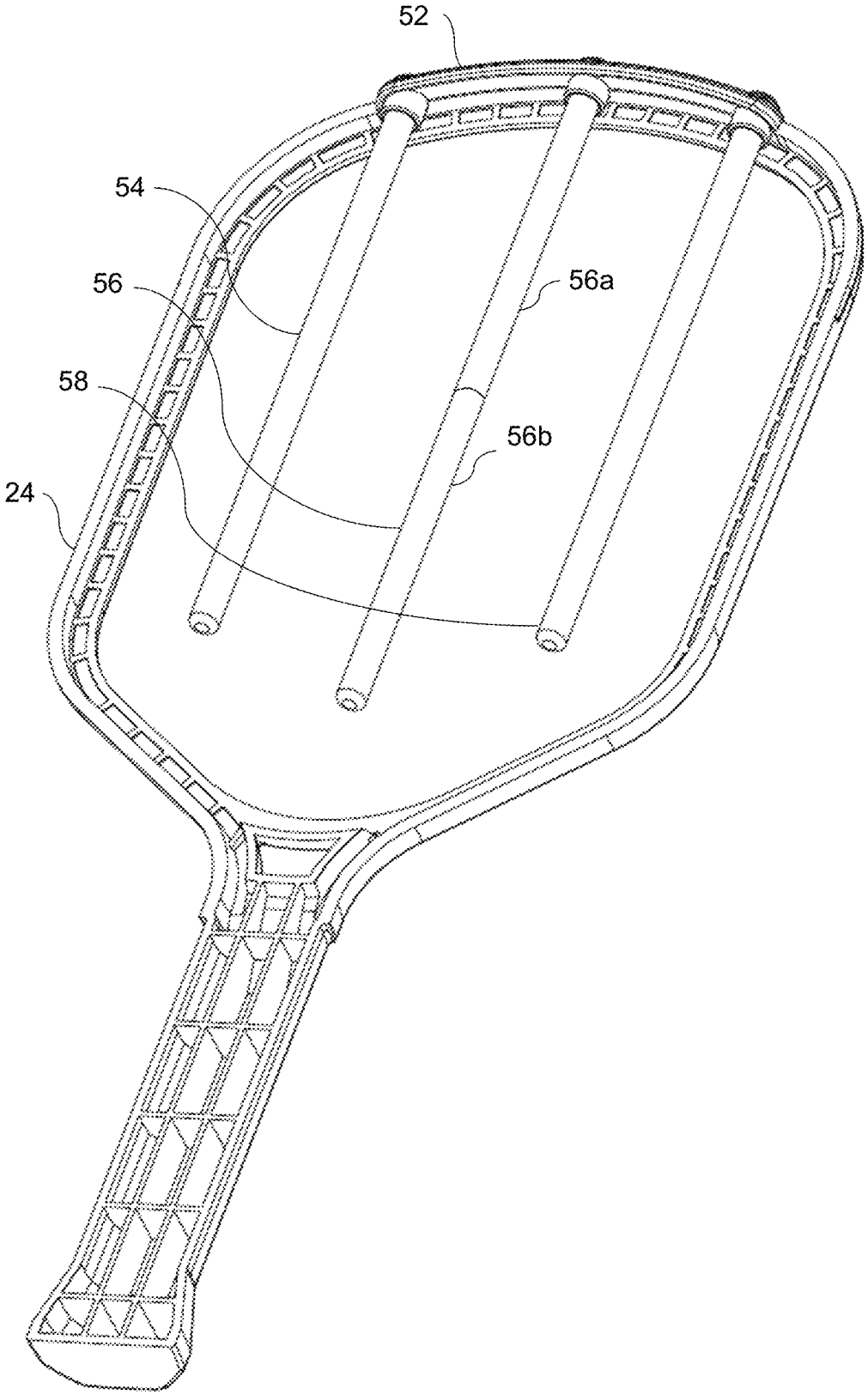
FIG. 14 is a perspective view of the same with the core removed for better clarity of the illustration.
Figure 15:
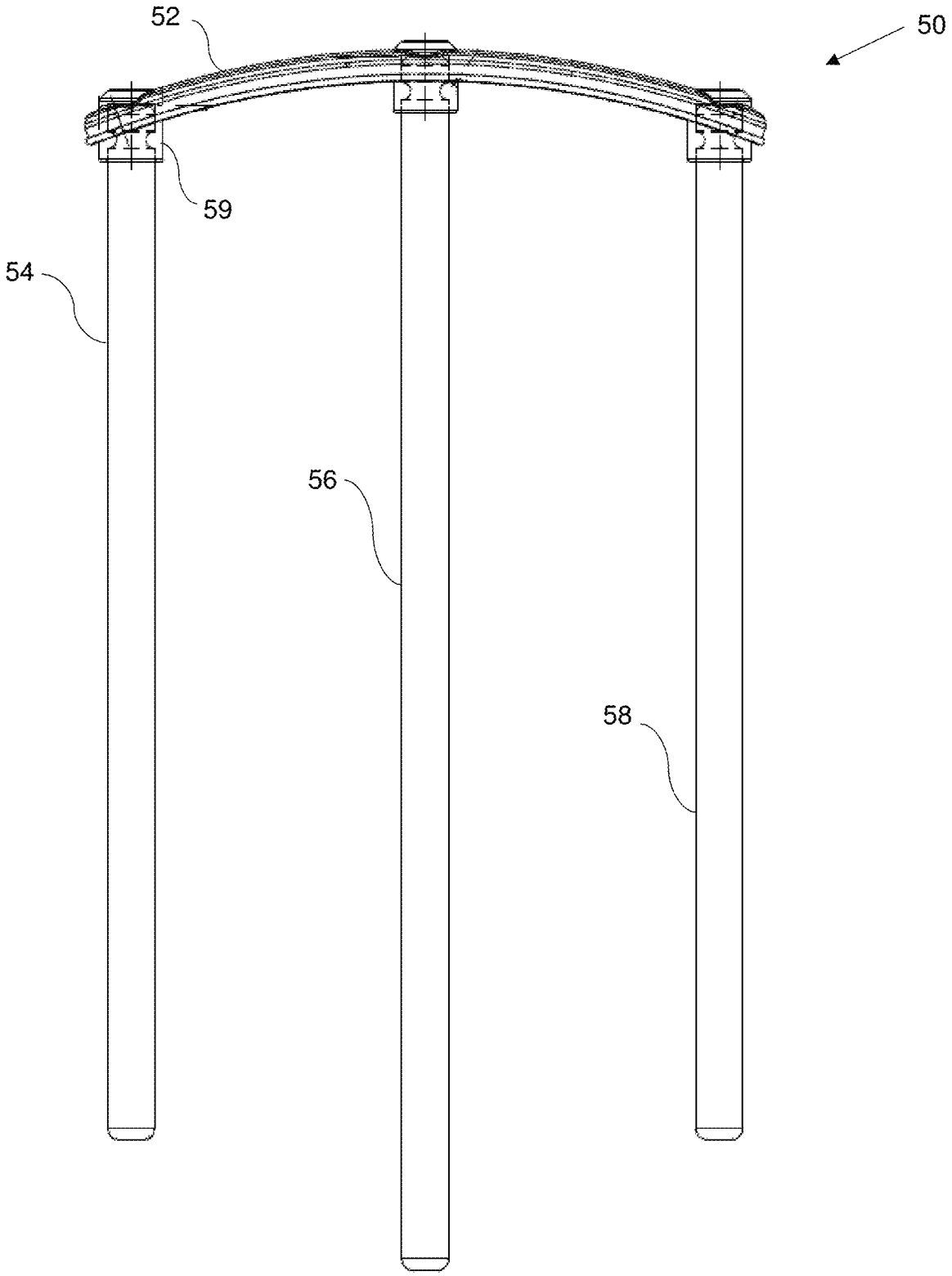
FIG. 15 is a plan view of the removable inserts.

At least one external face 22 of the paddle 10 may include a face fabric 30 seen in FIG. 7 and also seen in greater detail in FIG. 8. The face fabric 30 may be impregnated with and rigidized using melted polymer, which is followed by producing a desired top surface 32 on top of the external face 22. The zoomed-in details of the top surface 32 are seen in FIGS. 9 to 11 with an inch-graded scale included in FIG. 11.

The novel process of producing an external face 22 with an advantageous combination of features starts with the proper selection of the face fabric. As compared to conventional carbon fiber composite fabrics of the prior art, the present invention describes using a twill 3K carbon fiber/aramid hybrid fabric. In general terms, the twill 3K carbon fiber/aramid fabric hybrid fabric is a high-performance composite material that seamlessly combines the exceptional properties of 3K carbon fiber and aramid fiber. Aramid fibers are also known as poly-para-phenylene terephthalamide. This fiber and the fabric made therefrom is known for its remarkable strength-to-weight ratio, making it ideal for applications where lightweight yet robust construction is paramount. Its lightweight nature, derived from carbon fiber's low density, benefits other industries such as aerospace and automotive, where weight reduction is crucial. Moreover, this hybrid fabric boasts outstanding durability and resistance to wear, abrasion, and impact, ensuring longevity and reliability in harsh environments. Its flexibility and ability to conform to complex shapes, thanks to its twill weave pattern, add to its versatility.

The use of this fabric as a face fabric for the pickleball paddle 10 is novel. Despite its disadvantages of difficulty in handling and cutting to size, this fabric is unexpectedly discovered to provide a desired balance of all features described above when used in the construction of a pickleball paddle. Most importantly, the carbon fiber provides excellent tensile strength, while aramid fiber offers outstanding impact resistance. Together, they enhance the overall strength of the fabric and the quality of the paddle 10.

The following is a detailed description of the fabrication process developed to create a novel paddle 10. The process starts with molding a polypropylene honeycomb core 26 using a high-precision mold heated to a temperature at or exceeding the melting temperature of the polypropylene material, typically in the range from about 130° C. to about 150° C.

Carbon fiber substrate material is then added by wrapping it around the newly created honeycomb core 26 and heated again to a temperature between about 130° C. to about 150° C. in order to attach the carbon fiber substrate material to the honeycomb core 26.

The presoaked face fabric is then cut into sheets of suitable size and then hot-pressed onto the carbon fiber substrate of the paddle. Care is taken to apply even pressure throughout the external face of the paddle at a temperature of about 130° C. to about 150° C. This process may be aided by the use of temperature-resistant adhesive films to ensure proper alignment of all components of the paddle.

Finally, the top textured surface layer 32 is added by imprinting a mirror-shaped textured fabric onto the hot surface of the paddle face fabric impregnated with hot resin at the same temperature range as mentioned above.

Ball Paddle with Adjustable Weight

The present invention also describes a ball paddle with adjustable weight, which may be especially advantageous for a pickleball paddle. A pickleball paddle with individually adjustable twist weight and swing weight, according to the present invention, may offer improved versatility and customization, significantly enhancing the player's ability to tailor their equipment to their specific needs and playing style. This adjustability brings several key advantages, making such a paddle a valuable asset for both casual players and competitive athletes.

Adjusting the twist weight of the paddle allows players to fine-tune its torsional stability, which directly impacts control and accuracy. When the twist weight is increased, the paddle becomes more resistant to twisting during off-center hits. This results in a more stable and predictable response, reducing the likelihood of mishits and providing a more forgiving experience, especially for players who may not consistently strike the ball in the center of the paddle. This feature is particularly advantageous for beginners and intermediate players who are still refining their precision and consistency. Additionally, it benefits advanced players who want to maintain control during intense rallies and high-stakes matches, ensuring that off-center hits do not compromise their performance.

On the other hand, the ability to adjust the swing weight of the paddle influences its balance and the effort required to swing it. By increasing the swing weight, players can add more power to their shots, leveraging the added momentum to generate forceful and impactful hits. This is particularly useful for players who rely on powerful drives and smashes to dominate the game. Conversely, reducing the swing weight makes the paddle feel lighter and easier to maneuver, allowing for quicker hand movements and faster reaction times. This is ideal for players who prioritize speed, agility, and the ability to make rapid adjustments during fast-paced exchanges at the net. The capacity to alter the swing weight means that players can customize their paddle to suit different playing conditions or personal preferences, whether they need more power for aggressive baseline play or enhanced maneuverability for deft volleys and quick returns.

Furthermore, the adjustable features of such a paddle offer the flexibility to adapt to varying match scenarios and player conditions. For instance, a player might prefer a lower swing weight during a long tournament to reduce fatigue and maintain swift reactions, while opting for a higher twist weight to ensure stability and control as they tire. This adaptability can be a significant advantage during long matches or tournaments, where maintaining peak performance throughout is crucial.

Broadly speaking, a pickleball paddle with individually adjustable twist weight and swing weight, according to the present invention, may provide a customizable and dynamic playing experience. It may allow players to optimize their equipment to match their evolving skills, strategies, and physical condition, ensuring they can perform at their best in any situation. This level of customization not only enhances gameplay but also contributes to a more enjoyable and personalized playing experience, accommodating the unique preferences and strengths of each player.

The adjustable ball paddle of the second embodiment is broadly described below and illustrated in FIGS. 12-17. The paddle 10 for playing a ball game of the second embodiment, may include a paddle body comprising, in turn, a flat planar core 26 surrounded by an edge 24. The flat core 26 may be permanently attached to and positioned in between a pair of identical external faces on both flat sides thereof, not shown on the drawings. The external faces may be made according to the first embodiment of the invention, or utilize conventional paddle external faces, as the invention is not limited in this regard.

A handle 40 configured to hold and manipulate the paddle 10, may extend from the core 26 and be oriented to be co-planar therewith. The handle 40 may have a suitable external grip cover, as may be appreciated by those skilled in the art. The grip cover is not shown in the drawings for clarity of the illustrations.

An insert assembly 50 (seen in greater detail in FIG. 15) may be provided as a kit together with the paddle 10. The insert 50 may be adapted to be removably inserted into and retained by the paddle 10, and more specifically, by the flat core 26. The insert 50 may include an optional retainer 52 configured to be attached to the edge 24 of the paddle 10. In other embodiments, no retainer may be provided and the individual inserts may be placed into and retained within the paddle 10 by either interacting with the edge 24 and/or the flat core 26.

The insert assembly 50 may include one or more removable inserts, such as inserts 54, 56, and 58 extending in parallel from the retainer 52. In various alternative designs of the present invention, at least one, at least two, at least three, at least four, at least five, at least six, at least seven, at least eight or more inserts may be provided. The inserts may be removably placed within the corresponding channels of the flat core 26.

The design of the inserts and the corresponding channels may be selected to assure longitudinal symmetry and equivalent weight distribution on both sides of the longitudinal axis of symmetry of the paddle 10 so that one side of the paddle has the same weight and weight distribution as the other side.

At a minimum, the flat core 26 may be configured to removably accept a first insert 56 to fit within a thickness of the flat core 26. The first insert 56 may be configured to increase the stiffness of the flat core 26 when placed therein. To achieve this, the stiffness of the first insert 56 may be greater than the corresponding stiffness of the flat core 26. The first insert 56 may be formed to be straight and configured to be inserted into a corresponding first channel 57 made in the flat core and sized to accept the first insert 56 therein. The first channel 57 and the first insert 56 may be positioned along a longitudinal axis of symmetry of the paddle 10. The first insert 56 and additional inserts may be made from various metals such as aluminum, brass, copper, and alloys thereof. Alternatively, the first insert 56 and additional inserts may be made from a polymer, a carbon fiber, or a composite material.

In embodiments, the first channel 57 may have a first channel opening on the top side of the paddle 10 opposite the handle 40, thereby the paddle 10 may be configured to accept the first insert 56 when placed into the first channel 57 via a first channel opening from a top side of the paddle 10. Either the first channel 57 or the first insert 56 may be equipped with a first fastener configured to retain the first insert 56 when placed within the first channel 57. Examples of suitable fasteners may include twist-and-lock arrangements, friction fit locks, magnetic couplings, elastic retainers, etc, as the invention is not limited in this regard.

The first insert 56 may have a length exceeding at least one-half of the length of the flat core as measured from the handle. In this case, when inserted, the first insert 56 traverses more than one-half of the flat core length of the paddle 10. In one example, the length of the first insert may be at least 5 inches, at least 6 inches, at least 7 inches, at least 8 inches, at least 9 inches, at least 10 inches, at least 11 inches, at least 12 inches, or at least 13 inches.

The first insert 56 may not be made solid. In embodiments, the first insert 56 may itself comprise a first portion 56*a* serially attached to a second portion 56*b*, see FIG. 14. Both lengths may be the same or different. Splitting the insert 56 into two parts may be useful to allow for further customization of the paddle 10 as it can be used (i) without the insert, (ii) with only one part 56*a*, or (iii) with both parts 56*a* and 56*b* assembled together and inserted into the channel 57 of the paddle 10. As may be appreciated by those skilled in the art, the insert 56 may be provided in three pieces or even more pieces attached to each other in series for an even higher degree of weight adjustment. In addition, different parts of insert 56 may be made from different materials, such as materials having different weights. The player then may have a choice of using a lighter or a heavier part of the insert 56, as desired.

In embodiments, the first insert 56 may be tubular with a rigid outer wall. The external diameter of the tubular first insert may be from about 5 mm to about 16 mm or the maximum thickness of the paddle. To improve the ability of the player to adjust the weight of the paddle 10, the tubular first insert 56 may be configured to accept at least a first portion therein. The first portion may have a diameter suitably selected for such insertion. The first portion may be removably retained inside the tubular first insert using a variety of known fasteners, as mentioned above. Furthermore, the first portion may be tubular by itself. After the first portion is inserted concentrically into the tubular first insert 56, a second tubular or solid portion may be inserted concentrically therein.

The exemplary design of the insert assembly 50 shown in the drawings has three inserts, namely a first insert 56, a second insert 54, and a third insert 58. Each insert 54, 56, and 58 may include a fastener 59, such as a small groove sized to fit in an expandable opening of the retainer 52. Other fastener designs can be also used for the same purpose of allowing the insert to be removably retained in the flat core 26, as can be appreciated by those skilled in the art.

A pair of the second insert 54 and the third insert 58 may be configured for removable placement in a second channel 55 and a third channel 59 of the flat core 26, one on both sides of the first insert 56. The second channel 55 and the third channel 59 may be evenly spaced apart from the first channel 57 in the flat core 26 and may be positioned on both sides thereof. This may be done to preserve the symmetrical weight distribution of the paddle 10 when all three inserts 54, 56, and 58 are in use.

Depending on the use or removal of the inserts of the insert assembly 50, the paddle 10 may be configured to be used in one of the following configurations:

- with no inserts present, thereby providing a configuration with the lowest paddle weight,
- with only the first insert 56 present, thereby increasing the paddle weight and increasing the swing weight, while not changing the twist weight of the paddle 10,
- with only the second insert 54 and the third insert 58 present, thereby further increasing paddle 10 weight and also increasing its twist weight, and
- all three inserts present, thereby providing for maximum paddle weight, maximum swing weight, and maximum twist weight.

As a result, the use of inserts 54, 56, and 58 provides the paddle 10 with adjustable playing parameters to suit individual players.

All inserts 54, 56, and 58 may be identical and interchangeable with each other. In other embodiments, inserts 54 and 58 may be shorter or lighter than the insert 56.

In other embodiments, the inserts 54, 56, and 58 may form together a first set of inserts. The paddle 10 may be further provided with a second set of inserts configured to be inserted into the corresponding channels in the flat core of the paddle 10 in place of the first set of inserts. The second set of inserts may have a respective weight that is different from the first set of inserts, so as to provide additional paddle adjustment capability for the players.

Figure 16:
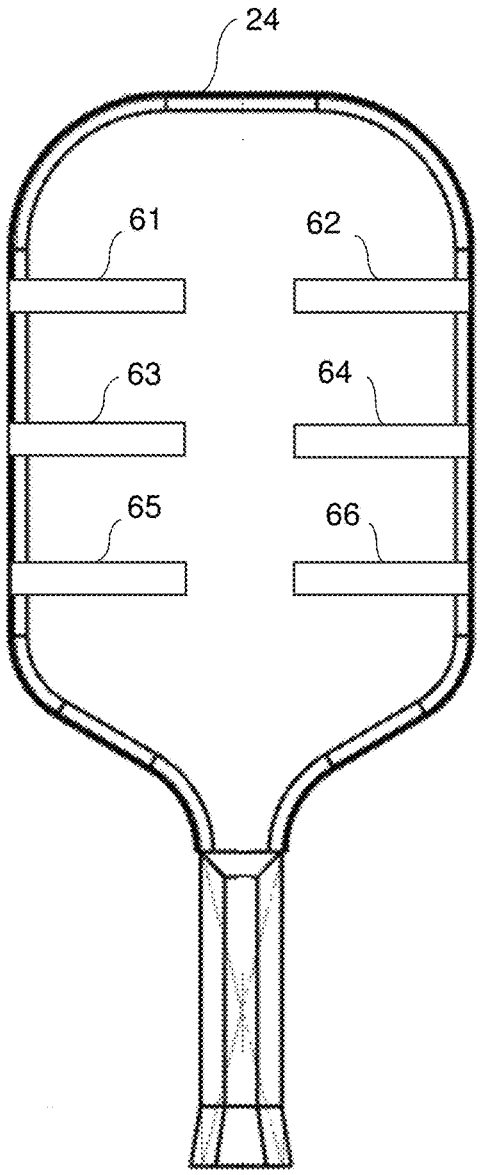
FIG. 16 is an alternative design of the adjustable paddle of the second embodiment.

FIG. 16 shows an alternative configuration of removable inserts for the flat core 26. Shown in FIG. 16 is a left series of inserts 61, 63, and 65 spaced apart along the longitudinal axis of the paddle 10, and a right series of inserts, namely inserts 62, 64, and 66, positioned on the right side of the paddle 10 symmetrically to the inserts of the left series. The use of these inserts may be done by inserting at least one pair of symmetrical inserts 61 and 62, or 63 and 64, or 65 and 66 into the flat core 26 using corresponding channels made in the flat core. Using these inserts would maximize the adjustment of the twist weight of the paddle 10 as they are located further away from the longitudinal axis of the paddle 10 as compared to the inserts described above.

Figure 17:
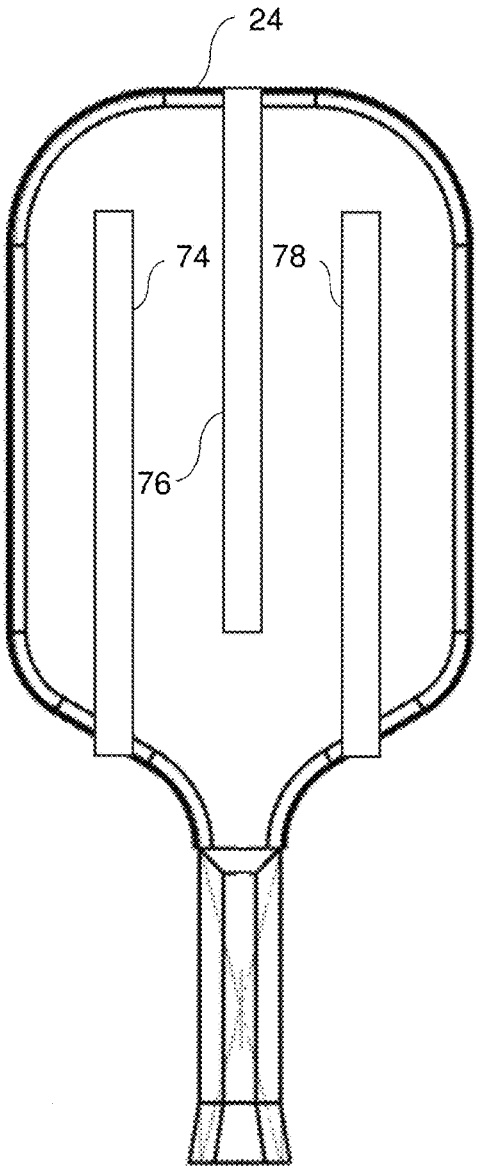
FIG. 17 is a further alternative design thereof.

A further alternative configuration of the removably positioned inserts is seen in FIG. 17. Similarly to the second embodiment described above, the inserts 74, 76, and 78 are arranged in parallel and positioned along the longitudinal axis of the paddle 10. However, inserts 74 and 78 are insertable from the handle side of the paddle 10, while insert 76 is insertable from the opposite, top side of the paddle 10.

Further configurations are also contemplated to be included in the scope of the claims of the present invention, such as inserts that may not be positioned in parallel to each other. in all cases, however, the use of the inserts assumes a symmetrical overall configuration of the paddle 10 once the desired inserts are placed therein.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic (s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if the order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refer to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least 1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. An adjustable paddle for playing a ball game, the paddle comprising a paddle body comprising, in turn, a flat planar core permanently attached to and positioned in between a pair of identical external faces on both flat sides thereof, and a handle configured to hold and manipulate the paddle, the handle extending from the core and oriented to be co-planar therewith, wherein the flat core is configured to removably accept a first insert to fit within a thickness of the flat core, the first insert is configured to increase a stiffness of the flat core when placed therein, wherein the first channel is positioned along a longitudinal axis of symmetry of the paddle, thereby facilitating independent adjustment in a swing weight and in a twist weight of the paddle, and wherein the first insert has a length exceeding at least one-half of a length of the flat core as measured from the handle, thereby when present, the first insert is configured to increase the stiffness of both a center and a periphery of the flat core.

2. The adjustable paddle, as in claim 1, wherein the first insert is straight and is configured to be inserted into a corresponding first channel made in the flat core and sized to accept the first insert therein.

3. The adjustable paddle, as in claim 1, wherein the first channel has a first channel opening on a side of the paddle opposite the handle, thereby the paddle is configured to accept the first insert when placed into the first channel via a first channel opening.

4. The adjustable paddle, as in claim 3, wherein either the first channel or the first insert is equipped with a first fastener configured to retain the first insert when placed within the first channel.

5. The adjustable paddle, as in claim 1, wherein the first insert comprises a first portion serially attached to a second portion.

6. The adjustable paddle, as in claim 1, wherein the first insert is tubular with a rigid outer wall.

7. The adjustable paddle, as in claim 6, the first insert comprises at least a first tubular portion inserted concentrically into a second tubular portion.

8. The adjustable paddle, as in claim 1, further comprising a pair of a second insert and a third insert configured for removable placement in a second channel and a third channel of the flat core, one on both sides of the first insert.

9. The adjustable paddle, as in claim 8, wherein the second channel and the third channel are evenly spaced apart from the first channel in the flat core and are positioned on both sides thereof.

10. The adjustable paddle, as in claim 8, wherein the paddle is configurable to be used in all of the following configurations:

i. with no inserts present, thereby providing a configuration with a lowest paddle weight, ii. with only the first insert present, thereby increasing paddle weight and increasing swing weight, while not changing twist weight of the paddle, iii. with only the second insert and the third insert present, thereby further increasing paddle weight and also increasing twist weight, and iv. all three inserts present, thereby providing for maximum paddle weight, maximum swing weight, and maximum twist weight, thereby providing the paddle with adjustable playing parameters to suit individual players.

11. The adjustable paddle, as in claim 8, wherein all inserts are identical and interchangeable with each other.

12. The adjustable paddle, as in claim 8, wherein the first insert, the second insert, and the third insert form together a first set of inserts, and wherein the paddle further comprises a second set of inserts configured to be inserted into the corresponding channels in the flat core of the paddle in place of the first set of inserts, the second set of inserts having respective weight that is different from the first set of inserts.

* * * * *